US005251599A

United States Patent [19]

Ohuchi et al.

[11] Patent Number: 5,251,599

[45] Date of Patent: Oct. 12, 1993

[54] INTERNAL COMBUSTION ENGINE CONTROL DEVICE HAVING EXHAUST GAS RECYCLE SYSTEM

[75] Inventors: Hirofumi Ohuchi; Yoshiaki Kanno, both of Hyogo, Japan

[73] Assignee: Mitsubishi Denki K.K., Tokyo, Japan

[21] Appl. No.: 895,848

[22] Filed: Jun. 9, 1992

[30] Foreign Application Priority Data

Jun. 10, 1991 [JP] Japan ..... 3-137455

[51] Int. Cl.[5] ..... F02M 25/07; F02D 41/08; F02P 5/12

[52] U.S. Cl. ..... 123/339; 123/416; 123/494; 123/571

[58] Field of Search ..... 123/568, 571, 676, 698, 123/339, 416, 417, 478, 494

[56] References Cited

U.S. PATENT DOCUMENTS

| | | | |
|---|---|---|---|
| 4,191,144 | 3/1980 | Nohira et al. | 123/571 X |
| 4,450,808 | 5/1984 | Moriyama et al. | 123/571 X |
| 4,715,348 | 12/1987 | Kobayashi | 123/571 |
| 4,770,146 | 9/1988 | Shibata et al. | 123/571 X |
| 4,825,841 | 5/1989 | Norota et al. | 123/676 |
| 5,137,004 | 8/1992 | Takahata et al. | 123/571 |

FOREIGN PATENT DOCUMENTS

| | | | |
|---|---|---|---|
| 52-27922 | 3/1977 | Japan . | |
| 56-165756 | 12/1981 | Japan . | |
| 62-51746 | 3/1987 | Japan . | |
| 0170747 | 7/1989 | Japan | 123/571 |

*Primary Examiner*—Willis R. Wolfe

*Attorney, Agent, or Firm*—Sughrue, Mion, Zinn, Macpeak & Seas

[57] ABSTRACT

An internal combustion engine control device having an exhaust gas recycle system which has an exhaust gas recycle line to an air intake pipe, the engine control device comprises at least pressure detect means as one of driving condition detect means for detecting a pressure for calculating an exhaust gas flow rate while said exhaust gas is recycled. A trouble detect means is provided for detecting a trouble in the exhaust gas recycle system on the basis of the pressure value detected by the pressure detect means. An engine control means is provided for controlling the engine speed based on the detected driving conditions by the driving condition detect means and based on an atmospheric pressure calculated from the pressure value detected by the pressure detect member.

4 Claims, 10 Drawing Sheets

INTERNAL COMBUSTION ENGINE CONTROL DEVICE HAVING EXHAUST GAS RECYCLE SYSTEM

BACKGROUND OF THE INVENTION

1. Field of the Invention

The present invention relates to an internal combustion engine control device having an exhaust gas recycle system which recycles part of exhaust gas of the internal combustion engine again into an air intake pipe of the engine, and which has a trouble detect device.

2. Description of the Related Art

Conventionally, the above-mentioned trouble detect device for an exhaust gas recycle (which is hereinafter referred to as EGR for short) device is disclosed in, for example, Japanese Patent Unexamined Publication No. Sho. 52-27922 and No. Sho. 62-51746, in which the variations of the flow rates of the EGR when the recycling of the exhaust gas is present or absent are detected by use of a negative pressure detector provided in the air intake pipe to thereby detect troubles in the EGR device.

Also, as disclosed in Japanese Patent Unexamined Publication No. Sho 56-165756, a pressure obtained from a proper quantity of EGR flow rate under a given condition, which is previously stored, is compared with a detect pressure obtained from an actual EGR flow rate to thereby detect a trouble in the EGR device, if any.

Each of these conventional devices includes pressure detect means as detect means for detecting the EGR flow rate.

Referring now to FIG. 9, there is shown a block diagram of a conventional trouble detect device for an EGR device. In FIG. 9, an electronic control unit 22 performs a fuel control, an engine idle speed control and the like.

The fuel control means is used to calculate a basic amount of fuel on the basis of information obtained from an air flow sensor 25 as well as the number of revolution information obtained from an igniter 14 and an ignition coil 13.

Next, there is added to the above basic amount of fuel a correction value obtained from a water temperature sensor 17, which shows the warming-up condition of an engine 1, and other similar devices to thereby find the amount of fuel that corresponds to the state of the engine. The amount of fuel that corresponds to the thus calculated amount of fuel is supplied from an injector 5 to the engine 1.

An air flow sensor 25 is a Karman's vortex street type air flow sensor which measures a volumetric flow rate as a quantity of air detected. Accordingly, as shown in FIG. 10, the air flow sensor 25 includes therein an air quantity detect section 25*a*, an intake air temperature sensor 25*b*, an intake air temperature/air quantity correct section 25*c*, an atmospheric air pressure sensor 25*d*, an atmospheric air quantity correct section 25*e* and an air quantity signal output section 25*f*. In particular, in the air flow sensor 25, on the basis of information from the air quantity detect section 25*a*, intake air temperature sensor 25*b*, intake air temperature/air quantity correct section 25*c* and atmospheric air pressure sensor 25*d*, the quantity of air is calculated and the calculated quantity of air is then corrected by the air pressure air quantity correct section 25*d*. Thereafter, the thus calculated and corrected quantity of air is converted by the air quantity signal output section 25*f* into a mass flow rate which is actually sucked into the engine, and the air quantity signal output section 25*f* then outputs to the electronic control device 22 a signal which corresponds to the converted actual mass flow rate.

When a vane type air flow sensor is used as the air flow sensor 25, similarly, the correction by the atmospheric pressure sensor is generally enforced and thus to the electronic control system 22 there is supplied a signal which corresponds to the flow rate after the correction.

As mentioned above, some of the air flow sensors require the atmospheric air correction. The requirement depends on the kinds of air flow sensors 25. Thus atmospheric air correction may be performed by provision of the atmospheric pressure sensor 25*d* separate from the air flow sensor 25 or by having the atmospheric pressure sensor 25*d* within the air flow sensor 25.

Further, an idle speed control device checks the engine 1 for its idle state on the basis of information from an idle switch 9, which indicates whether a throttle valve 7 is in its fully closed state or not, as well as information from a vehicle speed sensor 18 which decides whether a vehicle is stopped or not, that is, by use of combination of the idle switch 9 and speed sensor 18.

If it is decided that the engine 1 is in its idle state, then the idle speed control device, responsive to the idle state of the engine 1 and, for example, in accordance with a signal 19 which indicates a load state of an air conditioning apparatus (which will be hereinafter referred to as an air conditioner), bypasses a throttle valve 7 and controls an ISC valve 10 to thereby vary the quantity of an air to be sucked into the engine 1, that is, the idle speed control device controls the number of revolution of the engine by means of the variations of the quantity of the intake air.

Here, since the quantity of air necessary for the idle state varies in the air density thereof according to the altitude, the quantity of air is corrected in accordance with the altitude. This requires an atmospheric pressure sensor 25*d* which is used to detect the altitude.

As mentioned above, in the control device of the internal combustion engine, there is provided the atmospheric pressure sensor 25*d* to secure a necessary control accuracy and a correction is enforced in accordance with a signal from the atmospheric pressure sensor 25*d*.

Now, in FIG. 9, there are an air intake pipe 3, an intake manifold 4, a pressure sensor 6 being used to detect the pressure of the air intake pipe 3 and to output a detection output to the electronic control unit 22, a throttle opening degree sensor 8, a recycle valve 11 being provided in an exhaust gas recycle passage interposed between an air exhaust pipe 15 and the air intake pipe 3, a passage area control actuator 12 (which is hereinafter referred to as an EGR solenoid), a battery 20, an ignition key switch 21 being connected in series to the battery 20, and an alarm lamp 23 being driven by the electronic control device 22. In addition, a surge tank 24 is provided.

Since the conventional trouble detect and diagnosis device of the exhaust gas recycle device is constructed in the above-mentioned manner, it is necessary to detect the pressure in order to detect the EGR air and also the atmospheric pressure sensor 25*d* is added separately from sensors which are used in the control device of the internal combustion engine.

Also, in the conventional control device of the internal combustion engine, due to the fact that the atmospheric pressure is detected and the amount of control is corrected according to the detected atmospheric pressure, there is provided the atmospheric pressure sensor 25d for detection of the atmospheric pressure.

Namely, in the conventional internal combustion engine control device having the exhaust gas recycle system which has the trouble detect device, there must be provided two kinds of sensors, that is, the pressure sensor 6 and atmospheric pressure sensor 25d, which results in the increased costs of the whole device.

SUMMARY OF THE INVENTION

The present invention aims at eliminating the drawbacks found in the above-mentioned conventional device. Accordingly, it is an object of the invention to provide an internal combustion engine control device which is capable of detecting an atmospheric pressure by use of a single pressure sensor, eliminating the need for provision of an atmospheric pressure sensor which is necessary in the conventional control device, satisfying the function of the atmospheric pressure correction that is performed by the conventional control device, and minimizing the increased costs necessary in constructing the present trouble detect or diagnosis device.

In order to achieve the above object, according to the invention, there is provided a trouble detect device for use in an exhaust gas recycle device which includes pressure detect means for detecting a pressure used to detect an exhaust gas recycle flow rate at a given operating condition, and an electronic control device for storing as an atmospheric pressure the pressure used to detect the exhaust gas recycle flow rate at the given operating condition and for correcting the amount of control of an internal combustion engine by use of the atmospheric pressure.

According to the invention, the pressure detect means is operated to detect the pressure of the exhaust gas recycle flow rate under a given operating condition. And, the electronic control device is operated to store the detected pressure as an atmospheric pressure and to correct the amount of control of an internal combustion engine by use of the atmospheric pressure.

DETAIL DESCRIPTION OF THE PREFERRED EMBODIMENT

Figure 1:
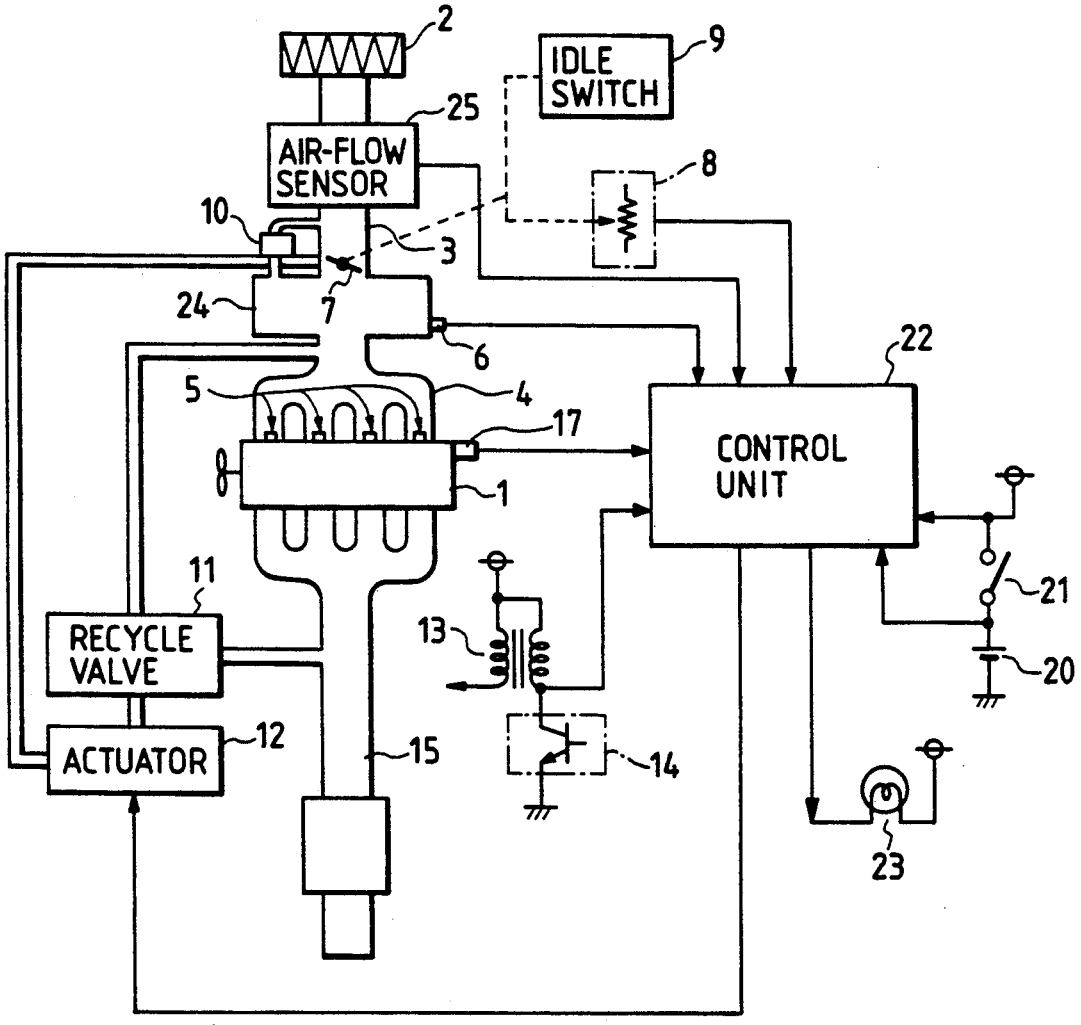
FIG. 1 is a block diagram of an embodiment of an internal combustion engine control system according to the invention.

Description will hereunder be given of an embodiment of an internal combustion engine control device which has an exhaust gas recycle system including a trouble detect section according to the invention with reference to the accompanying drawings. In FIG. 1, there is shown a block diagram of the above-mentioned embodiment.

Figure 9:
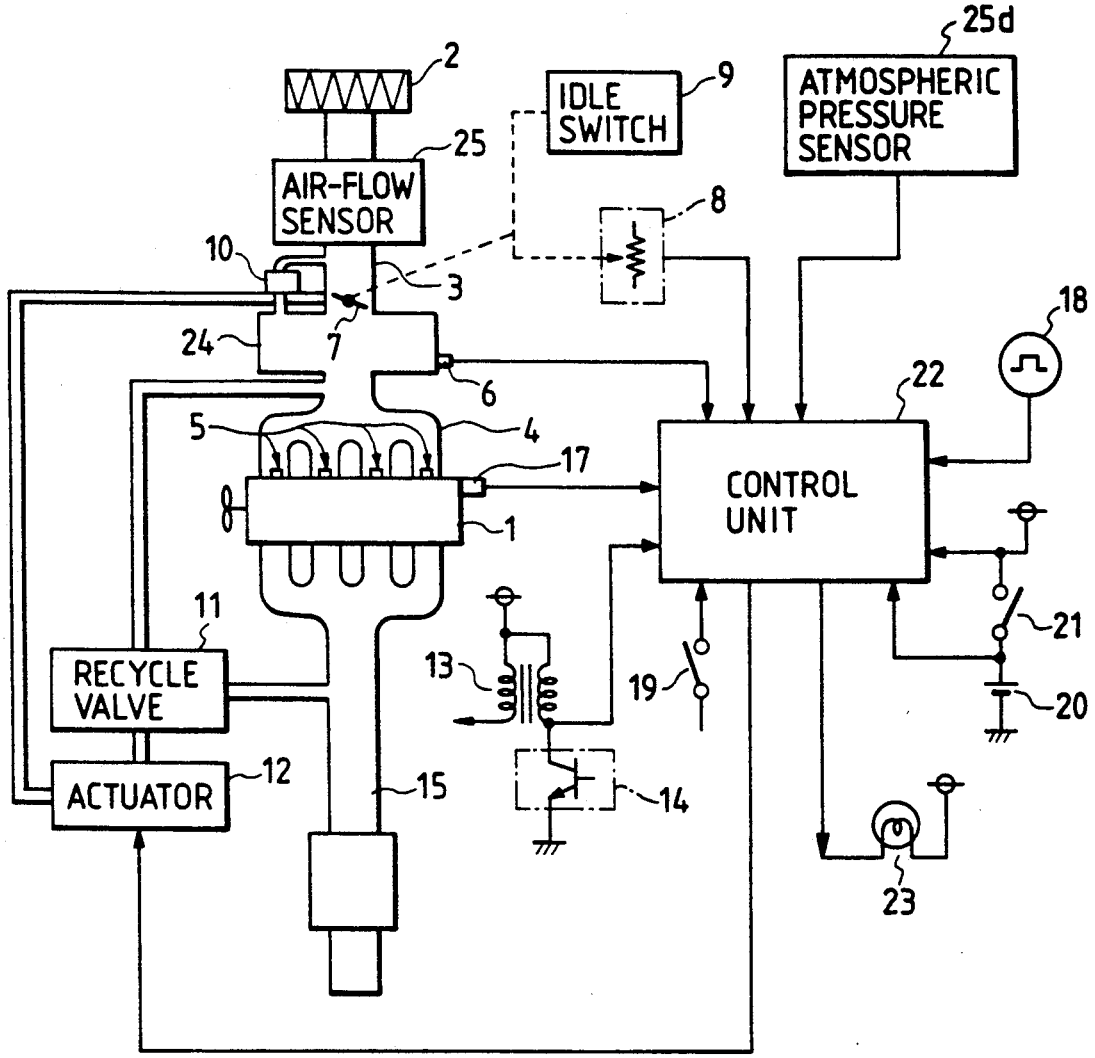
FIG. 9 is a block diagram of a conventional internal combustion engine control system; and, FIG. 10 is a block diagram of a conventional air flow sensor.
Figure 10:
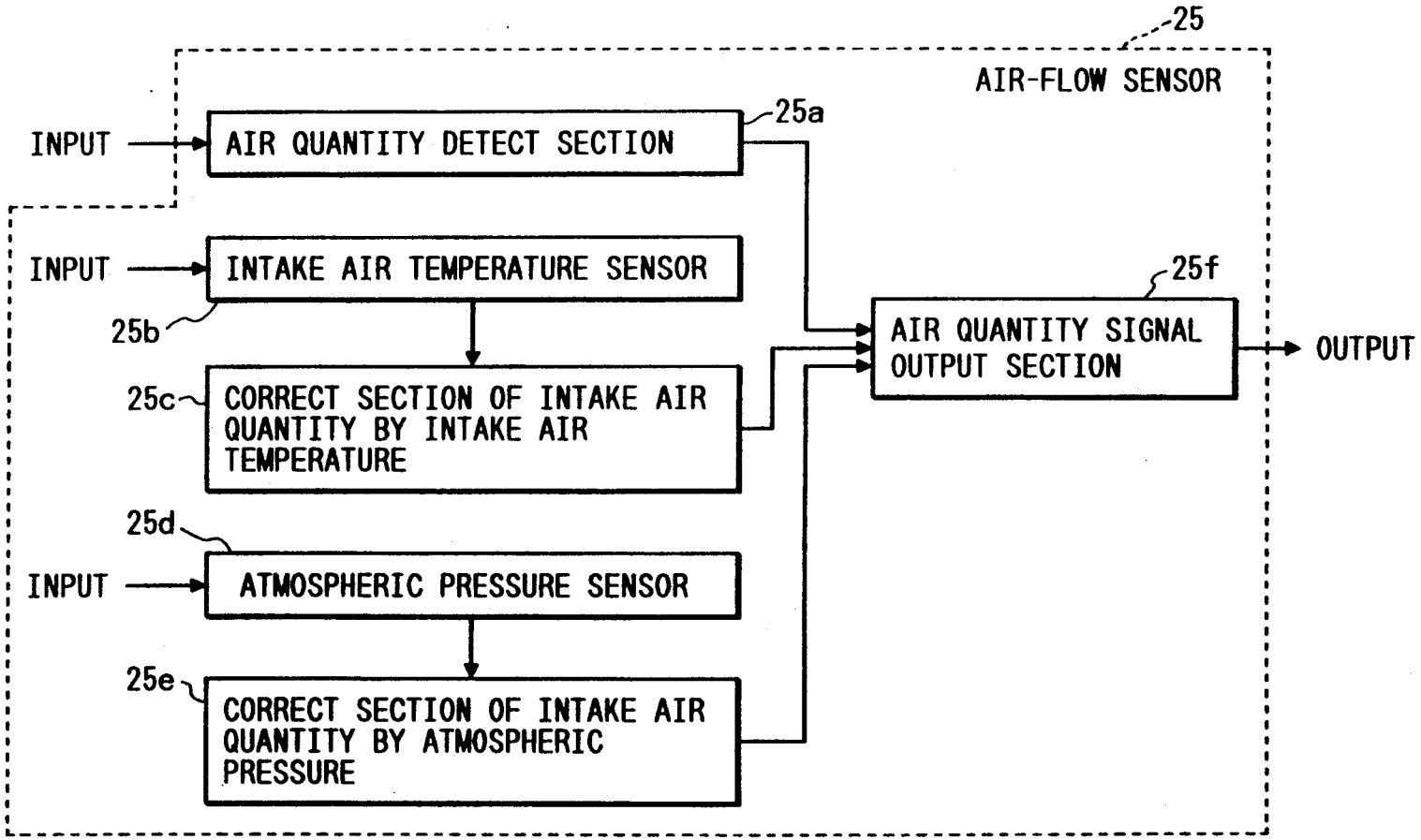

When describing the structure of the embodiment shown in FIG. 1, the same sections as in FIG. 9 are given the same designations and thus description will be given mainly of different sections from those shown in common with FIG. 9 to avoid the duplicated description thereof. As can be clearly seen from comparison of FIG. 1 with FIG. 9, in the structure shown in FIG. 1, there is omitted the signal that is shown in FIG. 9 to indicate the load condition of the air conditioner.

Further, in FIG. 1, an air flow sensor 25 is a Karman's vortex street type air flow sensor which measures the quantity of air to be taken through an air cleaner 2, an air intake pipe 3, a surge tank 24 and an intake manifold 4 into an engine 1.

Figure 2:
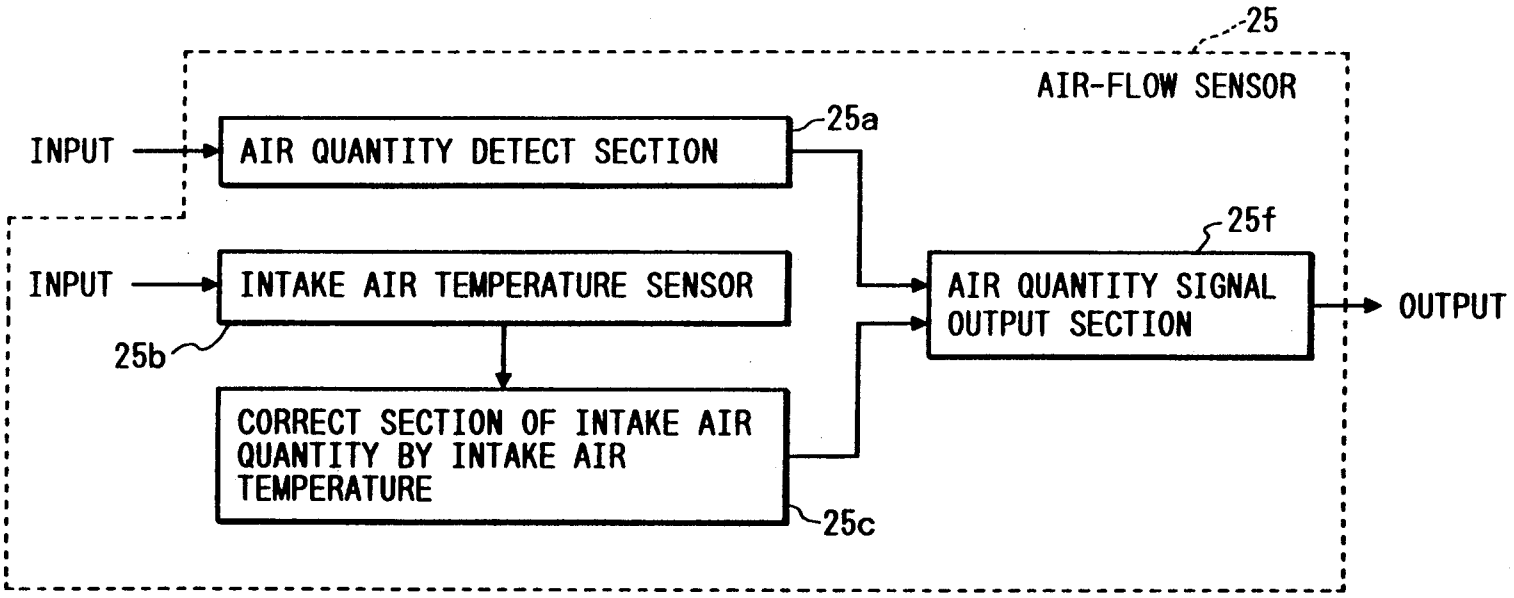
FIG. 2 is a block diagram of an air flow sensor used in the embodiment shown in FIG. 1.

The Karman's vortex street type air flow sensor is constructed in such manner as in FIG. 2 and includes therein only the intake air temperature sensor 25b, out of a pair of a intake air temperature sensor and an atmospheric pressure sensor which are used to convert the quantity of air measured, that is, a volumetric flow rate into a mass flow rate.

In other words, according to the air flow sensor shown in FIG. 2, the correction that is performed by an intake air temperature/air quantity correct section 25c is added to the information obtained by the air quantity detect section 25a and intake air temperature sensor 25b, and the sum of them is input to an air amount signal output section 25f, whereby the quantity of air detected is corrected only by the intake air temperature sensor 25b and the air quantity information is sent as an air quantity signal from the air quantity signal output section 25f to the electronic control device 22. Due to this, when compared with the conventional air flow sensor, the atmospheric pressure sensor is eliminated in the present air flow sensor.

Also, a plurality of injectors 5 are mounted to the respective cylinders of the intake manifold and are used to inject fuel, respectively.

The throttle valve 7 includes a throttle opening degree sensor 8 mounted thereto, which is used to detect the opening degrees of the throttle valve 7.

A water temperature sensor 17 is a thermistor type sensor which is used to detect the temperature of the cooling water of the engine 1. And, an ignition coil 13 carries out ignition in accordance with a signal from an igniter 14 and also transmits an ignition signal generated to the electronic control unit 22.

Also, a recycle valve 11 is a vacuum-servo type valve which is disposed in an exhaust gas recycle passage connecting the air intake pipe 3 and the exhaust pipe 15.

The electronic control unit 22 receives signals from the air flow sensor 25, ignition coil 13, water temperature sensor 17, pressure sensor 6 and battery voltage 20 to thereby drive and control the injector 5, and at the same time inputs signals respectively from the pressure sensor 6, throttle opening degree sensor 8, ignition coil 13 and water temperature sensor 17 to thereby drive and control an EGR solenoid 12.

Figure 3:
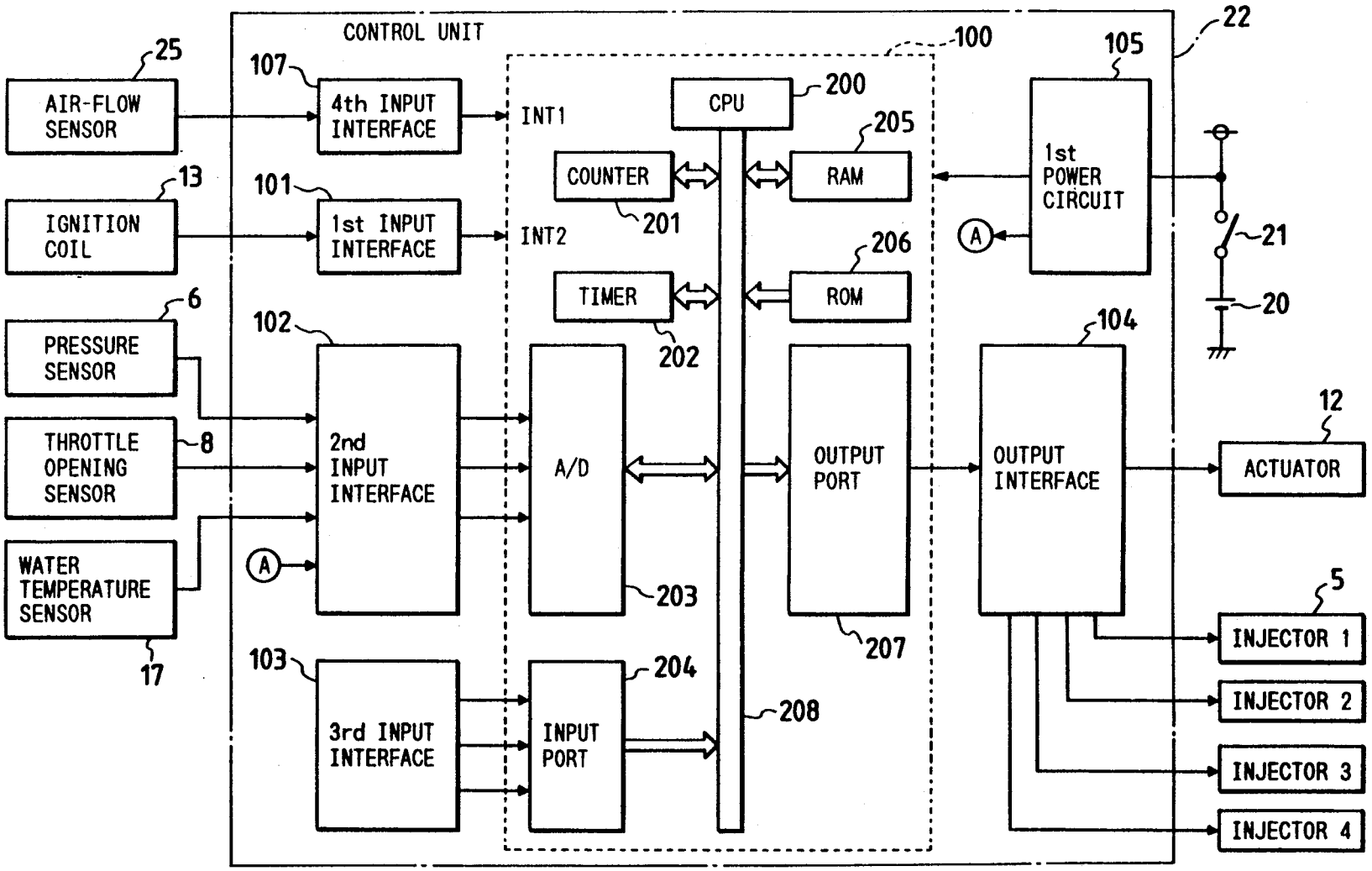
FIG. 3 is a block diagram of an electronic control unit used in the embodiment shown in FIG. 1.

FIG. 3 shows a block diagram of the present electronic control unit 22. In FIG. 3, a microcomputer 100 comprises a CPU 200 to calculate a fuel control amount, an EGR control amount and the like in accordance with a predetermined program, a free running counter 201 to measure a signal from the air flow sensor 25 and the number of revolution of the engine 1, a timer 202 to measure the drive time of the injector 5 and the drive time of the EGR solenoid 12, an A/D converter 203 to convert an analog signal into a digital signal, a RAM 205 to be used as a work memory, an input port 204, a ROM 206 in which programs are stored, an output port 207 to output a drive signal, a common bus 208 and the like.

Also, an input interface circuit 107 shapes the waveform of the signal from the air flow sensor 25 to thereby produce a first interrupt signal $INT_1$ and then outputs the first interrupt signal $INT_1$ to the microcomputer 1. When this interrupt signal is generated, then the CPU 200 counts the number of times of the interrupt signal and detects the amount of air on the basis of the number of times of the interruptions per predetermined time.

A first input interface circuit 101 shapes the waveform of a primary side ignition signal of the ignition coil 13 to thereby generate an interrupt signal and then outputs the interrupt signal to the microcomputer 100. When this interrupt signal is generated, then the CPU 200 reads the value of the counter 201 and, at the same time, calculates the cycle of the number of revolutions of the engine from a difference between the currently read value and the previously read value and stores the calculated cycle into the RAM 205.

A second input interface circuit 102 receives signals from the pressure sensor 6, throttle opening degree sensor 8, water temperature sensor 17 and the like and then outputs these signals to the A/D converter 203. Furthermore, a third input interface circuit 103 is provided.

And an output interface circuit 104 amplifies a drive output from the output port 207 and then outputs it to the injector 5 and the EGR solenoid 12.

Next, description will be given below of the operation of the present embodiment with reference to FIGS. 4 to 8.

Figure 4:
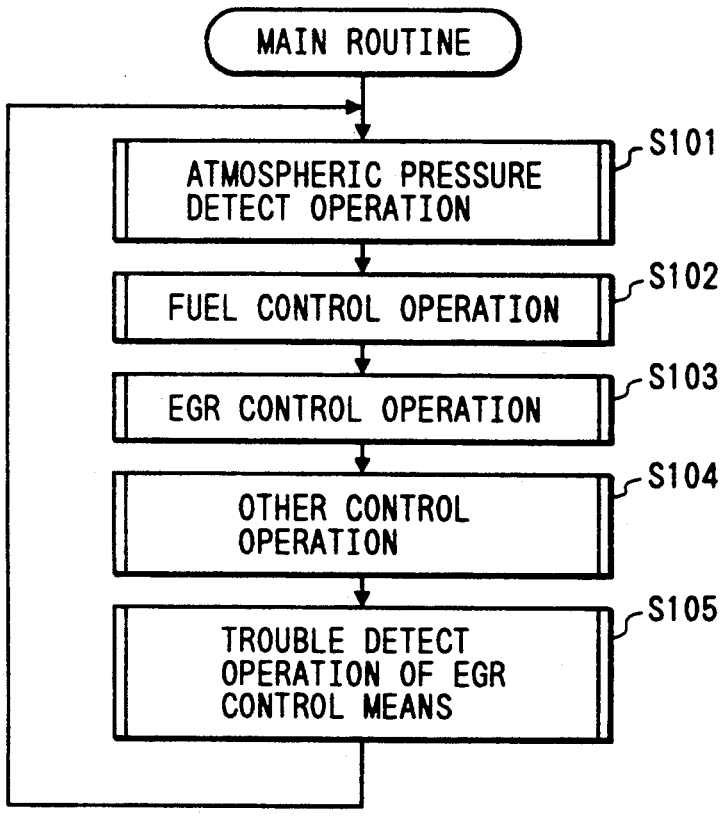
FIG. 4 is a flow chart of a main routine employed in the embodiment shown in FIG. 1.

At first, in FIG. 4, there is shown a main routine according to the invention. In Step S101, there is executed a processing to detect an atmospheric pressure on the basis of the information of the pressure sensor 6.

Then, in Step S102, a signal from the air flow sensor 25 is corrected according to the atmospheric pressure detected in Step S101 to thereby perform a fuel control processing. Next, in Step S103, an EGR control processing is performed according to various kinds of conditions checked.

Then, in Step S104, other control processing than the fuel and EGR control processing are executed (the details of which are not described herein). Next, in Step S105, a trouble detect processing of the EGR control device is carried out under a predetermined condition in accordance with the information of the pressure sensor 6.

Figure 5:
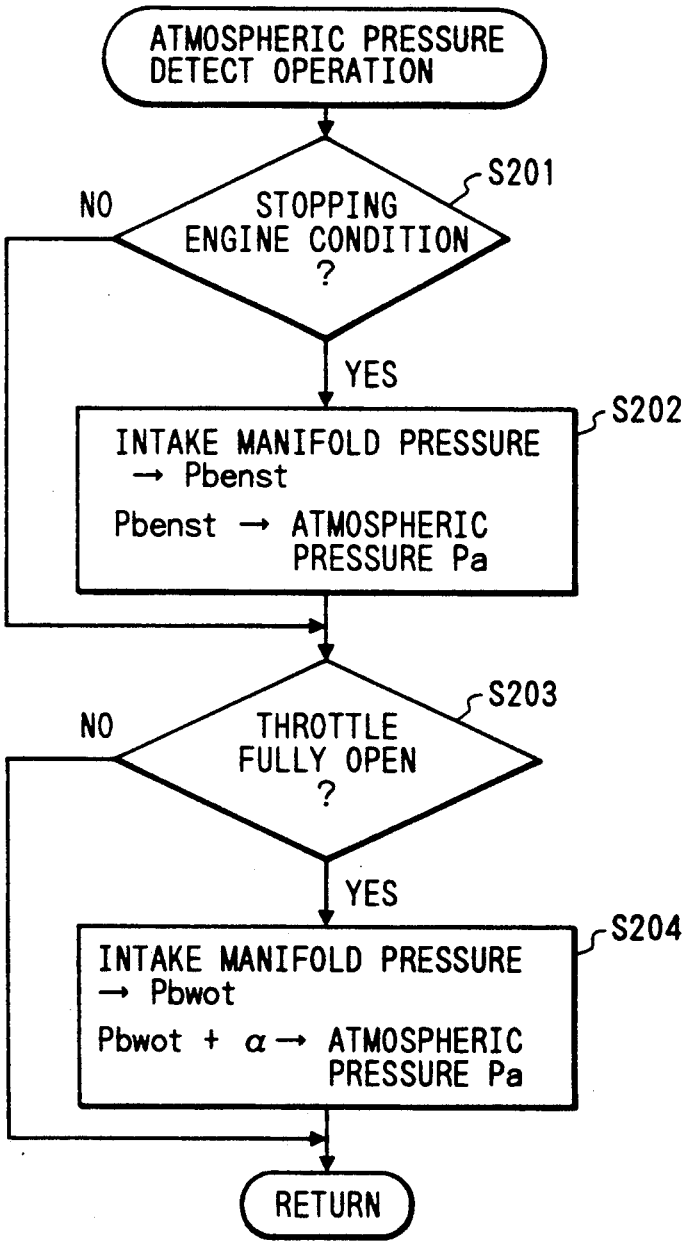
FIG. 5 is a flow chart of an atmospheric detect processing performed in the embodiment shown in FIG. 1.

Now, description will be given below of the atmospheric pressure detect processing with reference to an atmospheric flow chart shown in FIG. 5.

In Step S201, it is checked from the information on the number of revolution (the detail of which is not described herein) that is previously calculated in the interrupt operation whether the engine is in a stalled or stop condition (which will be hereinafter referred to as engine failure condition). If not in the engine failure condition, then the atmospheric pressure detection is not executed, but the processing is allowed to advance to Step S203. On the other hand, if in the engine failure condition, then in Step S202 the detection value of the pressure sensor 6 in the engine failure condition, that is, intake manifold pressure $Pb_{enst}$ is stored as an atmospheric pressure Pa because air is not yet sucked into the engine in the engine failure condition. Thereafter, the atmospheric pressure detection is executed.

Then, in Step S203, it is checked from the throttle opening degree information whether the opening degrees of the throttle valve are equal to or greater than a predetermined value or not, that is, whether the throttle valve is in a fully opened condition or not. If the throttle valve is not in the fully opened condition, then the atmospheric pressure detection processing is ended.

On the other hand, if in the fully opened condition, then the detection value of the pressure sensor 6 in the fully opened condition, that is, the intake manifold pressure $Pb_{WOT}$ in the fully opened condition shows a pressure which is decreased only by the pressure loss of the air sucking system from the atmospheric pressure.

In view of this, the pressure loss a is added to the intake manifold pressure $Pb_{WOT}$ that is detected in Step S204 and the resultant pressure is stored as the atmospheric pressure Pa, and then the atmospheric pressure detection is carried out. After then, the atmospheric pressure detect processing is ended.

Figure 6:
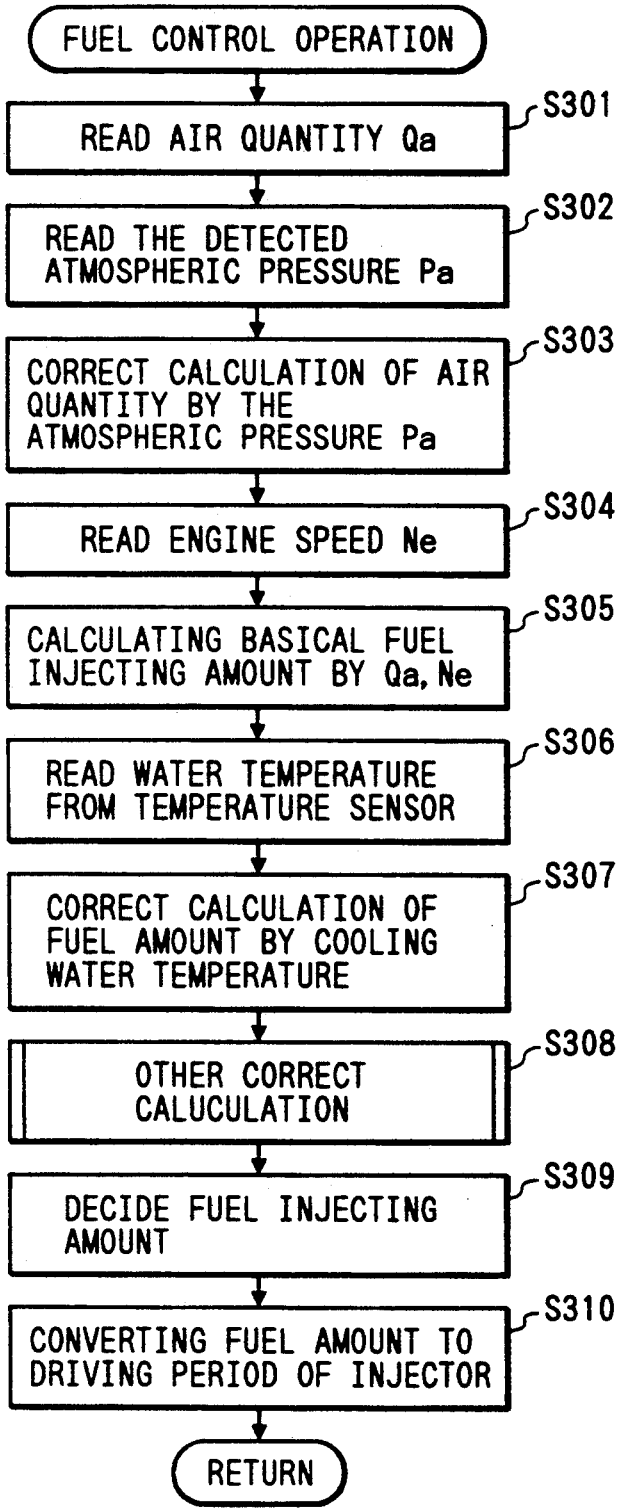
FIG. 6 is a flow chart of a fuel control processing performed in the embodiment shown in FIG. 1.

Next, description will be given below of the fuel control processing to the performed by the control device of the internal combustion engine with reference to a fuel control flow chart shown in FIG. 6.

At first, in Step S301, there is read out from the air flow sensor 25 a quantity of air Qa on which no atmospheric pressure correction has been performed. Next, in Step S302, there is read out the atmospheric pressure Pa that has been detected according to the atmospheric pressure detect flow chart shown in FIG. 5.

In Step S303, an atmospheric pressure correction processing is performed on the quantity of air read out in Step S301 by means of the atmospheric pressure Pa read out in Step S301, thereby calculating the quantity of air that is substantially sucked into the engine 1.

In Step S304, the number of revolution Ne that is detected by means of an interrupt processing (the details of which are not described herein) is input. Then, in Step S305, a basic amount of fuel is found from the quantity of air obtained in Step S303 and the number of revolution obtained in Step S304.

Next, in Steps S306 and S307, the cooling water temperature information, that is, an engine warming-up condition is read out from the water temperature sensor and an amount of correction of fuel is found according to the read-out engine warm-up condition.

In Step S308, an accelerating condition is detected from the throttle opening degree information and various kinds of correction such as correction of the amount of fuel and the like are carried out according to the accelerating condition detected.

Next, in Step S309, the amounts of correction found in Steps S307 and S308 are opened on the basic amount of fuel found in Step S305 to thereby find an amount of fuel to be discharged from the injector 5.

Finally, in Step S310, the thus calculated amount of fuel is processed by use of a battery voltage correction and the like and is then converted into a drive time of the injector 5. After then, the injectors are driven (the details of driving of the injectors are not described herein). By means of the above-mentioned steps, the control of fuel of the internal combustion engine is enforced.

Figure 7:
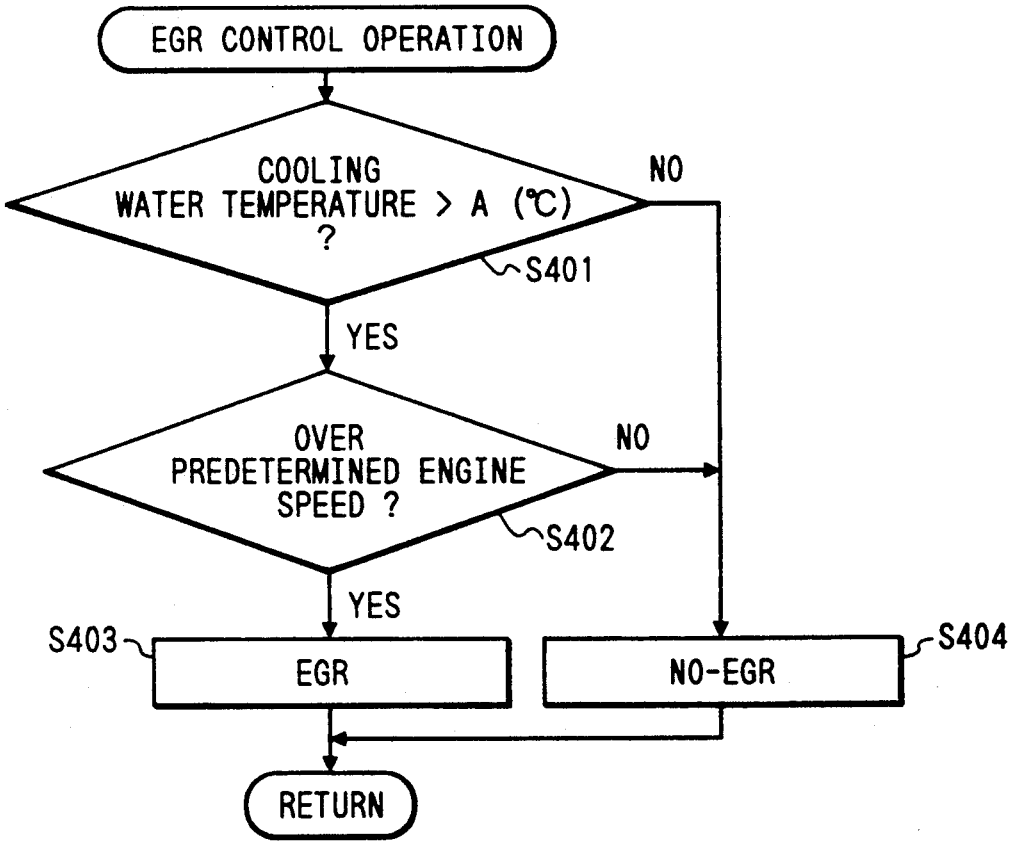
FIG. 7 is a flow chart of an EGR control processing performed in the embodiment shown in FIG. 1.

Next, description will be given of the EGR control with reference to FIG. 7. In Step S401, it is checked from the information from the water temperature sensor 17 whether the cooling water temperature exceeds a predetermined temperature AC or not.

As a result of this check, if it does not exceed the temperature AC, then it is decided that the engine is now being warmed up and the processing advances to Step S404 in which it is decided that the EGR is absent.

On the other hand, if it exceeds the temperature AC, then the processing goes to Step S402, in which it is checked whether the number of revolution is equal to or greater than a given number or not. As a result of this, if it is less than the given number, then the processing moves from the NO side of Step S402 to Step S404, in which it is decided that the EGR is absent. When the cooling water temperature exceeds the predetermined temperature and the number of revolution is equal to or greater than the given number, then it is decided in Step S403 that the EGR is present. That is, the EGR is controlled by these processing.

Figure 8:
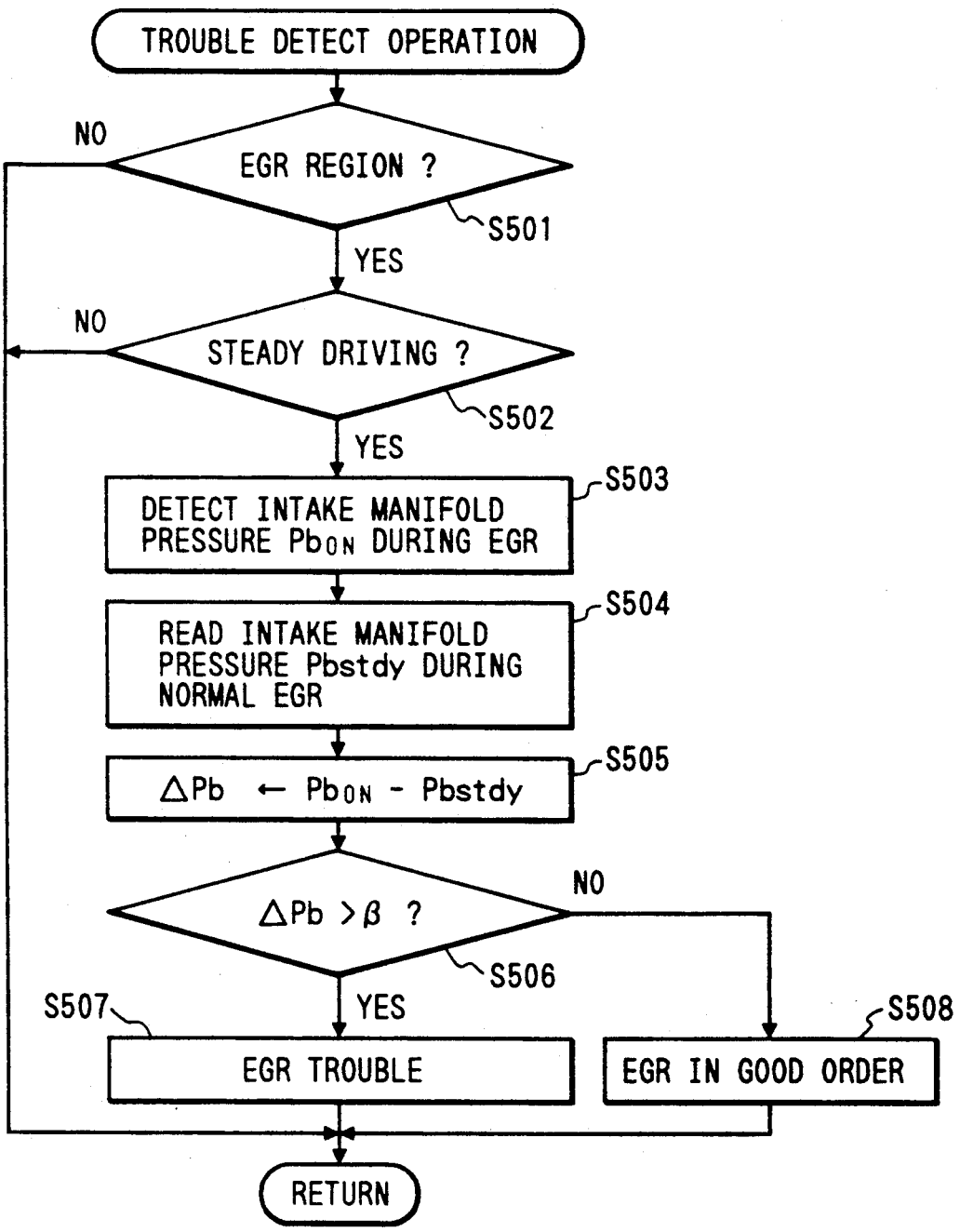
FIG. 8 is a flow chart of a trouble detect processing performed in the embodiment shown in FIG. 1.

Next, description will be given below of the trouble detect processing o the EGR device with reference to FIG. 8. At first, in Step S501, in accordance with the results of the EGR control executed along the flow chart in FIG. 7, it is checked whether the EGR is in the present area or in the absent area.

Here, if the EGR is in the absent area, then the trouble detection is not enforced. On the other hand, if in the present area, then the processing advances to Step S502. In Step S502, it is checked from the throttle opening degree and the number of revolution whether the engine is in a steady operation or not. As a result of this, if not in the steady operation, then the trouble detection is not enforced.

Next, in Step S503, the intake manifold pressure in the steady operation is detected from the pressure sensor 6. That is, there is detected and stored a pressure $Pb_{ON}$ which is obtained when the throttle opening degree is $B_{deg}$ and the number of revolution of the engine is $C_{rpm}$ during the steady operation.

In Step S504, intake manifold pressures ($Pb_{stdy}$) obtained when a normal EGR flow rate is recycled are previously stored under all load conditions and, from these storage values, there is read out an intake manifold pressure having the same condition as in Step S503, that is, the intake manifold pressure $Pb_{stdy}$ for the throttle opening degree $B_{deg}$ and the number of revolution $C_{rpm}$.

Next, in Step S505, there is detected a difference between the intake manifold pressure detect value $Pb_{ON}$ in the same operating condition and the intake manifold pressure $Pb_{stdy}$ when the EGR flow rate is recycled normally.

In Step S506, it is checked whether the difference detected in Step S505 is equal to or greater than a given value $\beta$ or not. If it is found that the difference is equal to or greater than the given value $\beta$, then in Step S507 it is decided that there is something wrong with the EGR flow rate, that is, the EGR device is wrong.

On the other hand, if the difference is smaller than the given value $\beta$, then in Step S508 it is decided that the EGR device is in good order. As mentioned above, the trouble detect processing of the EGR device is enforced according to the flow chart shown in FIG. 8 and by use of the detection value of the pressure sensor 6.

As has been described heretofore with reference to the flow charts respectively shown in FIGS. 4 to 8, according to the first embodiment of the invention, by use of a single pressure sensor, the trouble shooting for the EGR control device can be executed and also the atmospheric pressure is detected to thereby be able to perform an atmospheric pressure correction on the control device.

Now, when the above-mentioned first embodiment of the invention is applied to the trouble detect device which includes a Karman's vortex street type air flow meter, there can be eliminated the need for provision of the atmospheric pressure sensor that is necessary in the conventional device. According to the first embodiment of the invention, a similar effect can be expected also when it is applied to another type trouble detect device which employs a vane type air flow meter to enforce an atmospheric pressure correction.

Also, the first embodiment of the invention has been described when it is applied to a fuel control system as the engine control device. However, a similar effect can also be expected even when it is applied to other types of control devices including an idle speed control system which uses an atmospheric pressure sensor to detect an atmospheric pressure and enforces an atmospheric pressure correction on the thus detected atmospheric pressure during idling operation, and an ignition timing control system.

Further, in the above-mentioned first embodiment of the invention, the intake manifold pressure is used as the pressure detect means for detecting the EGR trouble. However, this is not limitative but a similar effect can be obtained also when there is used, as the pressure detect means, one of other pressures which are obtained at other pressure detect positions such as positions in the EGR recycle passage and the like.

As has been described hereinbefore, according to the present invention, due to the fact that a pressure sensor, which is provided as trouble detect means for an EGR device, is used to detect an atmospheric pressure under a given condition to thereby enforce a correction with respect to the atmospheric pressure, both of a pressure sensor for detection of the atmospheric pressure and a pressure sensor for detection of the trouble need not be provided, but only one sensor can be employed to provide a similar effect as in the two pressure sensors, which prevents the increased costs of the whole device due to provision of an additional pressure sensor.

What is claimed is:

1. An internal combustion engine control device having an exhaust gas recycle system which has an exhaust gas recycle line to an air intake pipe, in which an intake air passes through a throttle valve and intake manifold, said engine control device comprising:

driving condition detect means for detecting driving conditions of said internal combustion engine, in which a pressure detect member is provided downstream of said throttle valve for detecting a pressure value in said intake pipe for detecting an exhaust gas recycle condition while said exhaust gas is recycled;

trouble detect means for detecting a trouble in said exhaust gas recycle system on the basis of the pressure value detected by said pressure detect member; and engine control means for controlling the engine condition based on said detecting driving conditions by said driving condition detect means and an atmospheric pressure calculated from said pressure value detected by said pressure detect member, wherein said engine control means decides said pressure value detected by said pressure detect member as said atmospheric pressure during an engine failure condition and calculates said atmospheric pressure by adding a predetermined pressure loss of the air intake system to said pressure value detected by said pressure detect member.

2. An internal combustion engine control device according to claim 1, wherein said driving condition detect means includes an air-flow sensor having an air quantity detect section and intake air temperature detect section without an atmospheric pressure detect section, upstream said throttle valve, in which the quantity of air detected is corrected only by said intake air temperature detect section.

3. An internal combustion engine control device according to claim 2, wherein said internal combustion engine control means controls an amount of fuel to receive information of said quantity of air from said air-flow sensor.

4. An internal combustion engine control device according to claim 1, wherein said internal combustion engine control means controls at least one of idle speed and ignition timing.

* * * * *